US009929463B2

(12) United States Patent
Wu et al.

(10) Patent No.: US 9,929,463 B2
(45) Date of Patent: Mar. 27, 2018

(54) DUAL-BAND ANTENNA DISPOSED ON BOTH SIDES OF A SUBSTRATE

(71) Applicant: ARCADYAN TECHNOLOGY CORPORATION, Hsinchu (TW)

(72) Inventors: Min-Chi Wu, Hsinchu (TW); Chih-Yung Huang, Hsinchu (TW); Kuo-Chang Lo, Hsinchu (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 213 days.

(21) Appl. No.: 14/802,684

(22) Filed: Jul. 17, 2015

(65) Prior Publication Data

US 2016/0301133 A1 Oct. 13, 2016

(30) Foreign Application Priority Data

Apr. 7, 2015 (TW) ..... 104111130 A

(51) Int. Cl.

*H01Q 1/38* (2006.01)
*H01Q 9/42* (2006.01)
*H01Q 5/371* (2015.01)

(52) U.S. Cl.

CPC ..... *H01Q 1/38* (2013.01); *H01Q 5/371* (2015.01); *H01Q 9/42* (2013.01)

(58) Field of Classification Search

CPC ..... H01Q 1/38; H01Q 5/371; H01Q 9/42
USPC ..... 343/700 MS
See application file for complete search history.

(56) References Cited

U.S. PATENT DOCUMENTS

2008/0007478 A1* 1/2008 Jung ..... H01Q 1/38 343/895
2011/0074584 A1* 3/2011 Kataya ..... G06K 19/07749 340/572.8

* cited by examiner

*Primary Examiner* — Andrea Lindgren Baltzell
(74) *Attorney, Agent, or Firm* — Locke Lord LLP; Tim Tingkang Xia, Esq.

(57) ABSTRACT

A dual-band antenna disposed on the both sides of a substrate, including: a substrate, a first radiator and a second radiator. The substrate includes a first surface and a second surface; a feeding point is disposed at the edge of the first surface which may have a penetration hole electrically connected the first surface to the second surface. The first radiator extends from the first direction of the feeding point to the edge of the substrate, bend at the first corner, continues to extend toward the edge of the substrate, bends again at the second corner and then extend toward the third corner along the edge of the substrate. The second radiator straightly extends toward the second direction of the feeding point and the second direction's projection on the first surface is vertical to the first direction.

11 Claims, 4 Drawing Sheets

DUAL-BAND ANTENNA DISPOSED ON BOTH SIDES OF A SUBSTRATE

CROSS-REFERENCE TO RELATED APPLICATIONS

This non-provisional application claims priority under 35 U.S.C. § 119(a) on Patent Application No(s). 104111130 filed in Taiwan on Apr. 7, 2015, the entire contents of which are hereby incorporated by reference.

FIELD OF THE INVENTION

The present invention relates to a dual-band antenna disposed on both sides of a substrate, and more particularly, to an antenna designed to be changed and adjusted easily by enabling its radiators to be arranged primarily along the edge of its substrate, by that not only a longer antenna can be achieved, but also the so-constructed antenna can be adjusted and modified easily for allowing the same to achieve a required frequency while conforming to common wireless communication protocols.

BACKGROUND OF THE INVENTION

In the modern era of rapidly developing technology, it is in need of a smartly designed antenna with good transceiving ability that is effectively enough to be embedded in all kinds of modern handheld or portable electronic devices for wireless communication. Moreover, in response to the rapidly increasing types of electronic communication devices that are being made smaller and smaller and becoming available everyday, it is generally required to develop new antennas or antennas made of new materials that are to be embedded in various small handheld electronic devices or external wireless transmission devices, such as cellular phones, notebook computers, access points (APs) and card buses.

Generally, there are two types of antennas, i.e. the planar inverse-F antenna (PIFA) and monopole antenna, that are already been used in the modern handheld electronic devices since they are advantageous in their simplicity in structure and good transmission performance. Taking the PIFA from the aforesaid conventional antennas for instance, for enabling signal from an electronic device to be transmitted out through a PIFA that is electronically connected to the electronic device through a coaxial cable, the electric connection between the two is generally achieved by connecting the inner conductive layer and the outer conductive layer respectively to the signal feed point and the ground point of the PIFA.

SUMMARY OF THE INVENTION

In view of the disadvantages of prior art, the primary object of the present invention is to provide a dual-band antenna disposed on both sides of a substrate, which is an antenna designed to be changed and adjusted easily by enabling its radiators to be arranged primarily along the edge of its substrate, by that not only a longer antenna can be achieved, but also the so-constructed antenna can be adjusted and modified easily for allowing the same to achieve a required frequency while conforming to common wireless communication protocols, such as 802.11a (5150~5850 MHz), 802.11b (2400~2500 MHz), 802.11g (2400~2500 MHz), 802.11n (2400 MHz or 5000 MHz).

To achieve the above object, the present invention provides a dual-band antenna disposed on both sides of a substrate, which comprises: a substrate, formed with a first surface and a second surface in a manner that there is a feeding point disposed at a first edge of the first surface while the feeding point is further formed with a penetration hole to be used for electrically connecting the first surface to the second surface; a first radiator, arranged extending in a first direction from the feeding point along the first edge of the substrate, and then to be bended at a first corner so as to continue the extension along a second edge of the substrate, and then to be bended again at a second corner where it is further extending toward a third corner along a third edge of the substrate; a second radiator, arranged on the second surface for allowing the same to extend in a straight line from the feeding point in a second direction while enabling the projection of the second direction on the first surface to be perpendicular to the first direction, i.e. the second radiator is arranged extending from the feeding point to the portion of the first radiator that is disposed neighboring to the third edge, and the projection of the second radiator does not overlap the first radiator; wherein, the first radiator can be arranged in a manner selected from the group consisting of: the first radiator is arranged at a distance from the third corner, the first radiator is arranged extending just engaging to the third corner, and the first radiator is bended again at the third corner for allowing the extension of the first radiator to extend further toward a fourth corner along a fourth edge of the substrate by a length.

To achieve the above object, the present invention further provides a dual-band antenna disposed on both sides of a substrate, which comprises: a substrate, formed with a first surface and a second surface in a manner that there is a feeding point disposed at a first edge of the first surface while the feeding point is further formed with a penetration hole to be used for electrically connecting the first surface to the second surface; a first radiator, arranged extending in a first direction from the feeding point along the first edge of the substrate, and then to be bended at a first corner so as to continue the extension toward a second edge of the substrate, and then to be bended again at a second corner where it is further extending toward a third corner along a third edge of the substrate; a second radiator, arranged on the second surface for allowing the same to extend in a straight line from the feeding point in a second direction while enabling the projection of the second direction on the first surface to be perpendicular to the first direction, i.e. the second radiator is arranged extending from the feeding point to the portion of the first radiator that is disposed neighboring to the third edge, and the projection of the second radiator does not overlap the first radiator; a first matching unit, disposed on the first surface while being arranged extending in a third direction from the feeding point, and then to be bended at a first bend so as to continue the extension in a direction opposite to the first direction toward the fourth edge of the substrate, and then to be bended again at a second bend for enabling the same to extend toward a fourth corner along a fourth edge of the substrate; a second matching unit, disposed on the first surface while being arranged extending in the third direction from the second bend, and then to be bended at a third bend so as to continue the extension in the first direction, i.e. the extension of the second matching unit in the first direction is the portion of the second matching unit that is extending toward the portion of the first radiator arranged neighboring to the second edge, and the projection of the portion of the second matching unit that is extending along the first direction is disposed intersecting with the second radiator; wherein, the first radiator can be arranged in a manner selected from the group consisting of: the first radiator is arranged at a distance from the third corner, the first radiator is arranged extending just engaging to the third corner, and the first radiator is bended again at the third corner for allowing the extension of the first radiator to extend further toward the fourth corner along a fourth edge of the substrate by a length; and the third direction is arranged perpendicular to the first direction.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
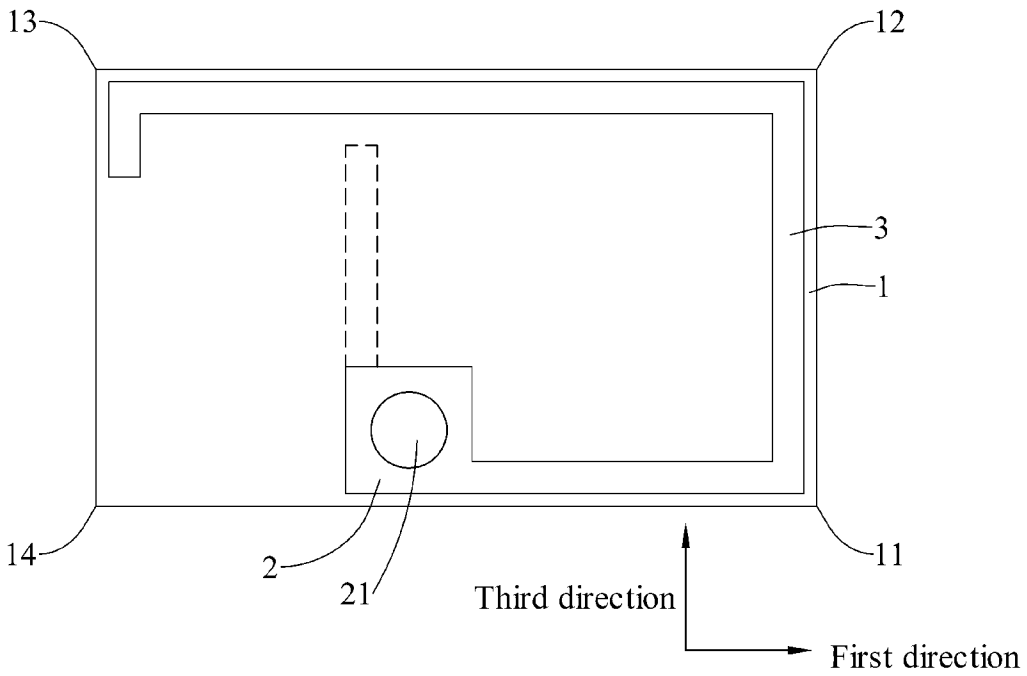
FIG. 1 is a schematic diagram showing an antenna layout on a first surface of a dual-band antenna that is disposed on both sides of a substrate according to a first embodiment of the present invention.
Figure 2:
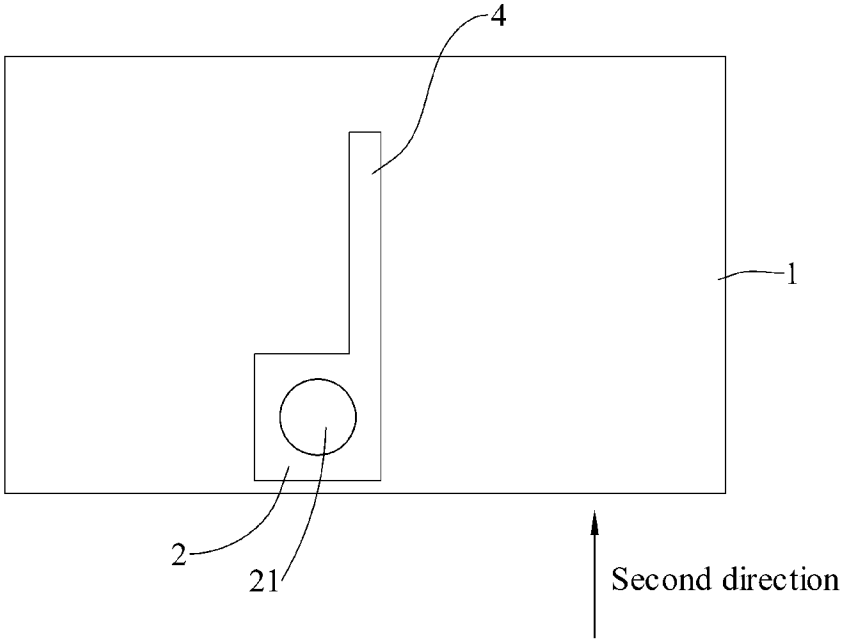
FIG. 2 is a schematic view is a schematic diagram showing an antenna layout on a second surface of a dual-band antenna that is disposed on both sides of a substrate according to a first embodiment of the present invention.

Please refer to FIG. 1 and FIG. 2, which are schematic diagrams showing respectively an antenna layout on a first surface and a second surface of a dual-band antenna that is disposed on both sides of a substrate according to a first embodiment of the present invention. In this first embodiment, the disclosed dual-band antenna comprises: a substrate 1, which can be a printed circuitboard and is formed with a first surface and a second surface in a manner that there is a feeding point 2 disposed at an edge of the first surface at a position near to the center of the first edge while the feeding point 2 is further formed with a penetration hole 21 to be used for electrically connecting the first surface to the second surface; a first radiator 3, arranged extending in a first direction from the feeding point 2 along the edge of the substrate 1, and then to be bended at a first corner 11 so as to continue the extension along the edge of the substrate 1, and then to be bended again at a second corner 12 where it is further extending toward a third corner 13 along the edge of the substrate 1, and then bended again at the third corner 13 for allowing the extension of the first radiator 3 to extend further toward a fourth corner 14 along the edge of the substrate 1 by a length that is no longer than half the length of the edge of the substrate 1; a second radiator 4, arranged extending in a straight line from the feeding point 2 in a second direction until exceeding the center of the substrate 1, while enabling the projection of the second direction on the first surface to be perpendicular to the first direction, i.e. the second radiator 4 is arranged extending from the feeding point 2 to the portion of the first radiator 3 that is disposed between the second corner 12 and the third corner 13, and the projection of the second radiator 4 does not overlap the first radiator 3; wherein, the feeding point 2 is provided for connecting electrically to a 50Ω transmission line or a cable.

Figure 3:
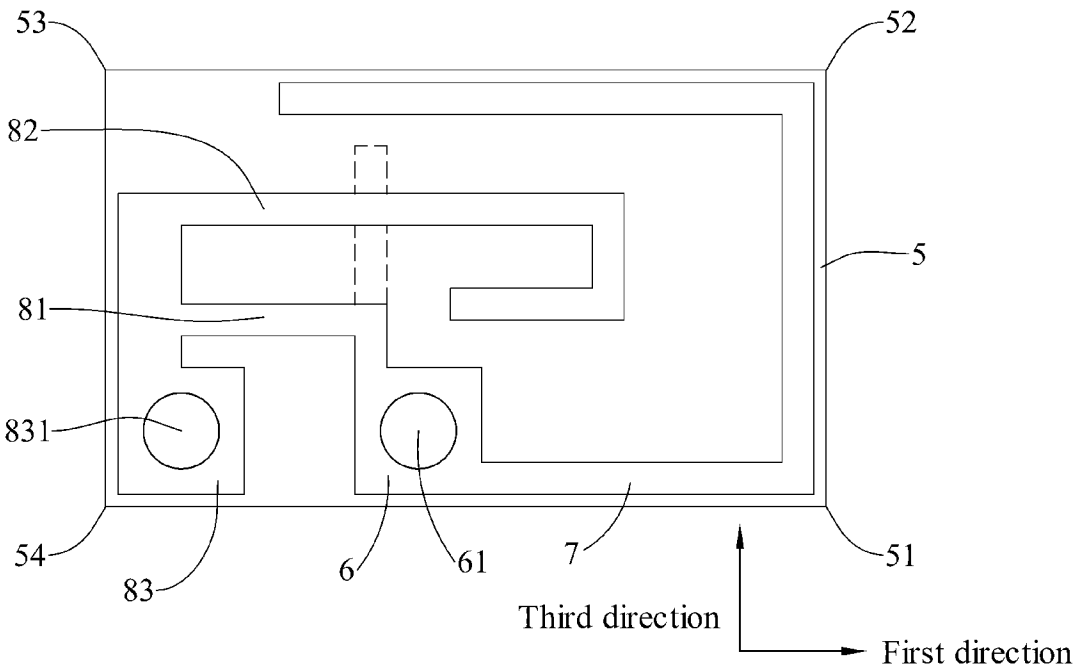
FIG. 3 is a schematic view is a schematic diagram showing an antenna layout on a first surface of a dual-band antenna that is disposed on both sides of a substrate according to a second embodiment of the present invention.
Figure 4:
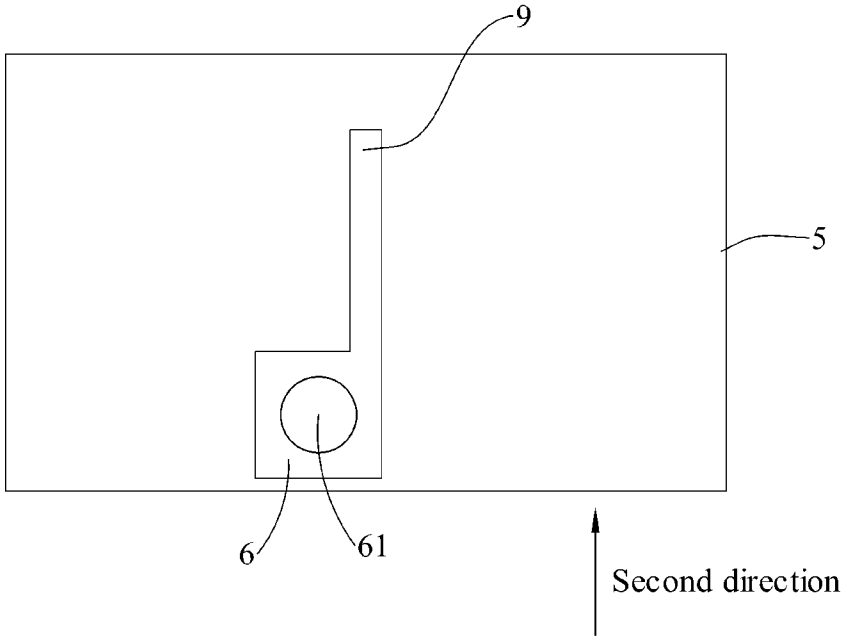
FIG. 4 is a schematic view is a schematic diagram showing an antenna layout on a second surface of a dual-band antenna that is disposed on both sides of a substrate according to a second embodiment of the present invention.

Please refer to FIG. 3 and FIG. 4, which are schematic diagrams showing respectively an antenna layout on a first surface and a second surface of a dual-band antenna that is disposed on both sides of a substrate according to a second embodiment of the present invention. In this second embodiment, the disclosed dual-band antenna comprises: a substrate 5, which can be a printed circuitboard and is formed with a first surface and a second surface in a manner that there is a feeding point 6 disposed at an edge of the first surface while the feeding point 2 is further formed with a penetration hole 21 to be used for electrically connecting the first surface to the second surface; a first radiator 7, formed on the first surface while being arranged extending in a first direction from the feeding point 6 along the edge of the substrate 5, and then to be bended at a first corner 51 so as to continue the extension along the edge of the substrate 5, and then to be bended again at a second corner 52 where it is further extending toward and ended at a third corner 53 along the edge of the substrate 1; a second radiator 9, formed on the second surface while being arranged extending in a straight line from the feeding point 6 in a second direction, while enabling the projection of the second direction on the first surface to be perpendicular to the first direction, i.e. the second radiator 9 is arranged extending from the feeding point 6 to the portion of the first radiator 7 that is disposed between the second corner 52 and the third corner 53, and the projection of the second radiator 9 does not overlap the first radiator 7; a first matching unit 81, disposed on the first surface while being arranged extending in a third direction from the feeding point 6, and then to be bended at a first bend so as to continue the extension in a direction opposite to the first direction toward the edge of the substrate 5, and then to be bended again at a second bend for enabling the same to extend toward a fourth corner 54; a second matching unit 82, disposed on the first surface while being arranged extending in the third direction from the second bend, and then to be bended at a third bend so as to continue the extension in the first direction, i.e. the extension of the second matching unit 82 in the first direction is the portion of the second matching unit 82 that is extending toward the portion of the first radiator 7 arranged between the first corner 51 and the second corner 52, and the projection of the portion of the second matching unit 82 that is extending along the first direction is disposed intersecting with the second radiator 9; wherein, the third direction is perpendicular to the first direction; the feeding point 6 is provided for connecting electrically to a 50Ω transmission line or a cable; and the first matching unit 81 is arranged extending to a ground region 83 formed at an end of the fourth corner 54 while allowing the ground region 83 to connect to a system ground of an electronic device, and the ground region 83 is further formed with a through-hole via 831 at the center thereof.

In the present invention. The substrate can be formed like an quadrangle, while allowing the aforesaid first corner, second corner, third corner and fourth corner to be used as the four corners of the quadrangle, by that the first edge is the edge of the quadrangle ranged between the first corner and the fourth corner, the third edge is the edge of the quadrangle ranged between the second corner and the third corner, the third edge is the edge of the quadrangle ranged between the first corner and the second corner, the fourth edge is the edge of the quadrangle ranged between the third corner and the fourth corner, and the first edge is arranged parallel to the third edge while the third edge is arranged parallel to the fourth edge. In another embodiment, the substrate can be formed like a polygon, while allowing the aforesaid first corner, second corner, third corner and fourth corner to be used as any four corners of the polygon, by that the first edge is the edge of the polygon ranged between the first corner and the fourth corner, the third edge is the edge of the polygon ranged between the second corner and the third corner, the third edge is the edge of the polygon ranged between the first corner and the second corner, the fourth edge is the edge of the polygon ranged between the third corner and the fourth corner, and the first edge is arranged parallel to the third edge, but the second edge and the fourth edge can be arranged symmetrically and asymmetrically with respect to each other.

According to the embodiments shown in FIG. 1 to FIG. 4, the primary object of the present invention is to provide a dual-band antenna disposed on both sides of a substrate, which is an antenna designed to be changed and adjusted easily by enabling its radiators to be arranged primarily along the edge of its substrate, by that not only a longer antenna can be achieved, but also the so-constructed antenna can be adjusted and modified easily for allowing the same to achieve a required frequency while conforming to common wireless communication protocols, such as 802.11a (5150~5850 MHz), 802.11b (2400~2500 MHz), 802.11g (2400~2500 MHz), 802.11n (2400 MHz or 5000 MHz).

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A dual-band antenna disposed on both sides of a substrate, comprising:

a substrate, formed with a first surface and a second surface in a manner that there is a feeding point disposed at a first edge of the first surface while the feeding point is further formed with a penetration hole to be used for electrically connecting the first surface to the second surface;

a first radiator, arranged extending in a first direction from the feeding point along the first edge of the substrate, and then to be bended at a first corner so as to continue the extension along a second edge of the substrate, and then to be bended again at a second corner where it is further extending toward a third corner along a third edge of the substrate; and a second radiator, arranged on the second surface for allowing the same to extend in a straight line from the feeding point in a second direction while enabling the projection of the second direction on the first surface to be perpendicular to the first direction, i.e. the second radiator is arranged extending from the feeding point to the portion of the first radiator that is disposed neighboring to the third edge, and the projection of the second radiator does not overlap the first radiator.

2. The dual-band antenna of claim 1, wherein the straight extension of the second radiator is extending over the center of the substrate.

3. The dual-band antenna of claim 1, wherein the first radiator is further bended again at the third corner for allowing the extension of the first radiator to extend further toward a fourth corner along a fourth edge of the substrate by a length.

4. The dual-band antenna of claim 3, wherein the length of the portion of the first radiator that is extending toward the fourth corner is not longer than half of edge length of the substrate.

5. The dual-band antenna of claim 1, wherein the substrate is substantially a printed circuitboard.

6. The dual-band antenna of claim 1, wherein the feeding point is provided for connecting electrically to a 50 Ω transmission line or a cable.

7. A dual-band antenna disposed on both sides of a substrate, comprising:

a substrate, formed with a first surface and a second surface in a manner that there is a feeding point disposed at a first edge of the first surface while the feeding point is further formed with a penetration hole to be used for electrically connecting the first surface to the second surface;

a first radiator, disposed on the first surface and arranged extending in a first direction from the feeding point along the first edge of the substrate, and then to be bended at a first corner so as to continue the extension toward a second edge of the substrate, and then to be bended again at a second corner where it is further extending toward a third corner along a third edge of the substrate;

a second radiator, arranged on the second surface for allowing the same to extend in a straight line from the feeding point in a second direction while enabling the projection of the second direction on the first surface to be perpendicular to the first direction, i.e. the second radiator is arranged extending from the feeding point to the portion of the first radiator that is disposed neighboring to the third edge, and the projection of the second radiator does not overlap the first radiator;

a first matching unit, disposed on the first surface while being arranged extending in a third direction from the feeding point, and then to be bended at a first bend so as to continue the extension in a direction opposite to the first direction toward the fourth edge of the substrate, and then to be bended again at a second bend for enabling the same to extend toward a fourth corner along a fourth edge of the substrate; and a second matching unit, disposed on the first surface while being arranged extending in the third direction from the second bend, and then to be bended at a third bend so as to continue the extension in the first direction, i.e. the extension of the second matching unit in the first direction is the portion of the second matching unit that is extending toward the portion of the first radiator arranged neighboring to the second edge, and the projection of the portion of the second matching unit that is extending along the first direction is disposed intersecting with the second radiator;

wherein, the third direction is arranged perpendicular to the first direction.

8. The dual-band antenna of claim 7, wherein the first matching unit is arranged extending to a ground region formed at an end of the fourth corner, and the ground region is further formed with a through-hole via at the center thereof.

9. The dual-band antenna of claim 8, wherein the ground region is provided for connecting to a system ground of an electronic device.

10. The dual-band antenna of claim 7, wherein the substrate is substantially a printed circuitboard.

11. The dual-band antenna of claim 7, wherein the feeding point is provided for connecting electrically to a 50 Ω transmission line or a cable.

* * * * *